US010661301B2

(12) United States Patent
Thomazic et al.

(10) Patent No.: US 10,661,301 B2
(45) Date of Patent: May 26, 2020

(54) PRINTING PROCESS FOR ORAL DOSAGE FORMS

(71) Applicant: Capsugel Belgium NV, Bornem (BE)

(72) Inventors: Sylvain Thomazic, Trédion (FR); Vincent Bechtel, Paimpont (FR); Jan Emiel Godelieve Vertommen, Humbeek (BE)

(73) Assignee: Capsugel Belgium NV, Bornem (BE)

( * ) Notice: Subject to any disclaimer, the term of this patent is extended or adjusted under 35 U.S.C. 154(b) by 250 days.

(21) Appl. No.: 15/762,536

(22) PCT Filed: Aug. 8, 2016

(86) PCT No.: PCT/EP2016/068833
§ 371 (c)(1),
(2) Date: Mar. 22, 2018

(87) PCT Pub. No.: WO2017/067685
PCT Pub. Date: Apr. 27, 2017

(65) Prior Publication Data

US 2018/0339309 A1 Nov. 29, 2018

Related U.S. Application Data

(60) Provisional application No. 62/244,250, filed on Oct. 21, 2015.

(51) Int. Cl.
*B41F 17/00* (2006.01)
*B05D 1/26* (2006.01)
(Continued)

(52) U.S. Cl.
CPC ..... *B05D 1/26* (2013.01); *A61J 3/007* (2013.01); *B41F 17/36* (2013.01); *B41M 7/0009* (2013.01)

(58) Field of Classification Search
CPC . B41F 17/00; B41M 7/00; A61J 3/007; B23K 26/03
(Continued)

(56) References Cited

U.S. PATENT DOCUMENTS 3,618,764 A * 11/1971 Bawduniak ..... B07C 5/342 209/580
4,216,714 A * 8/1980 Ackley, Sr. ..... B41F 17/36 101/110
(Continued)

FOREIGN PATENT DOCUMENTS

EP 2184047 5/2010
EP 3365180 12/2019
(Continued)

OTHER PUBLICATIONS

Hutchinson, K. G. et al., "Soft gelatin capsules," in Aulton's Pharmaceutics: The Design & Manufacture of Medicine, Ch. 35, pp. 527-538, edited by Aulton, M., third edition (2001).
(Continued)

*Primary Examiner* — Cachet I Proctor
(74) *Attorney, Agent, or Firm* — Klarquist Sparkman, LLP

(57) ABSTRACT

A printing process for dosage forms selected from hard or soft capsules, the process comprising the steps of: (i) providing a plurality of said dosage forms, preferably filled with a liquid composition, in a reservoir; (ii) transferring a predetermined number of the dosage forms from said reservoir to a printing station; (iii) printing indicia over each of the dosage forms; (iv) transferring the printed dosage forms to an inspection station arranged to sense a predetermined characteristic of the indicia; (v) sorting the dosage forms based on the sensed predetermined characteristic of the indicia by separating dosage forms that meet the predetermined characteristics from dosage forms that do not meet
(Continued)

the predetermined characteristics; wherein the dosage forms that do not meet the predetermined characteristics are collected and further processed through a regenerating unit arranged to remove the indicia from the dosage forms in a regeneration step, and further re-processed according to steps (i) to (v).

16 Claims, 1 Drawing Sheet

(51) Int. Cl.
*B41M 7/00* (2006.01)
*A61J 3/00* (2006.01)
*B41F 17/36* (2006.01)

(58) Field of Classification Search
USPC ..... 427/8
See application file for complete search history.

(56) References Cited

U.S. PATENT DOCUMENTS 8,102,520 B2 * 1/2012 Ackley, Jr. ..... B07C 5/3412 356/237.1
8,888,005 B2 * 11/2014 Prokop ..... G06F 19/3462 235/440
2002/0098235 A1 * 7/2002 Dittmar ..... A61K 9/2846 424/472
2005/0084525 A1 * 4/2005 Abinusawa ..... A61J 3/007 424/456
2010/0045976 A1 * 2/2010 Jorritsma ..... G01N 21/9508 356/240.1
2011/0178099 A1 * 7/2011 Stefanic ..... A61K 31/519 514/254.09
2014/0238818 A1 * 8/2014 Schombert ..... B65G 47/1464 198/340

FOREIGN PATENT DOCUMENTS

WO WO91/01884 2/1991
WO WO2017/067685 4/2017

OTHER PUBLICATIONS

International Search Report and Written Opinion for PCT/EP2016/068833 (dated Nov. 11, 2016).

* cited by examiner

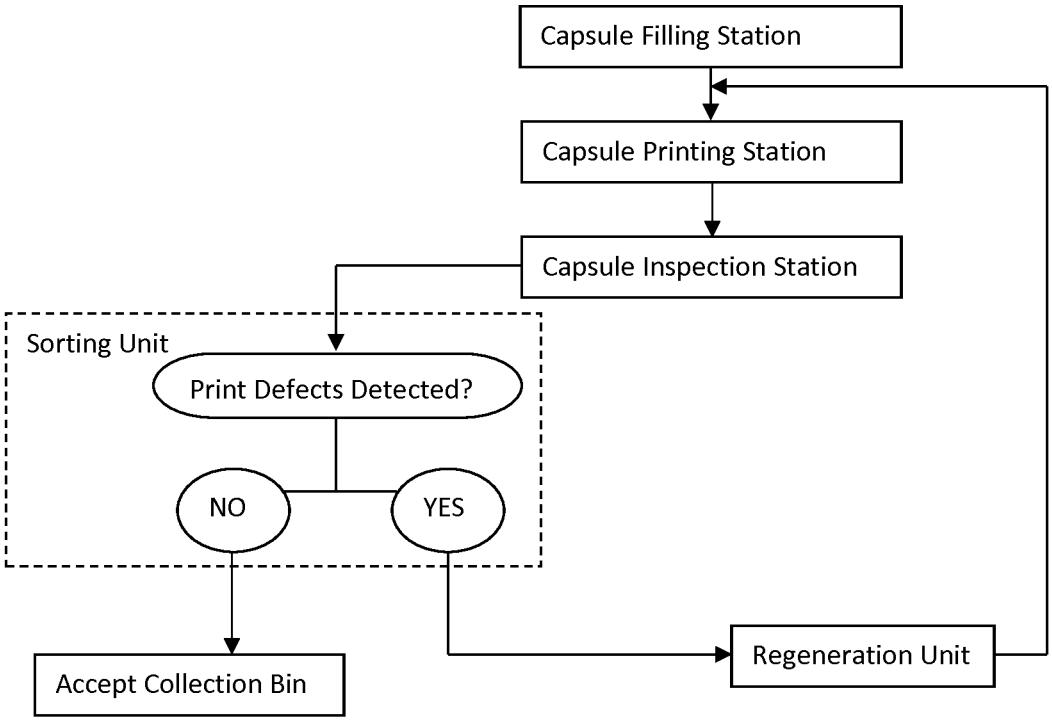
Capsule Filling Station
Capsule Printing Station
Capsule Inspection Station
Sorting Unit
Print Defects Detected?
NO
YES
Accept Collection Bin
Regeneration Unit

PRINTING PROCESS FOR ORAL DOSAGE FORMS

CROSS REFERENCE TO RELATED APPLICATIONS

This is the U.S. National Stage of International Application No. PCT/EP2016/068833, filed Aug. 8, 2016, which was published in English under PCT Article 21(2), which in turn claims the benefit of U.S. Provisional Application No. 62/244,250, filed Oct. 21, 2015, which is incorporated herein in its entirety.

FIELD

The present disclosure relates to a printing process for hard or soft, preferably soft, capsules that enables to limit the amount of filled capsules being scrapped. More particularly, the capsules herein are ultimately for assimilation by a subject via oral or other route, preferably the subject being selected from humans or animals.

BACKGROUND

Capsule technology continues to be subject to development and improvements. Such capsules typically come in two main forms, either in the form of hard capsule shells or in the form of soft capsules (also referred to as softgels or soft gel capsules).

Hard capsule shells are generally manufactured using dip molding processes involving the use of pins dipped into solutions of the different ingredients that are needed for the making of the capsule shell containers. Methods for the manufacturing of soft gelatin or softgel capsule shells are also known in the art and are different from hard capsule shell manufacturing. Manufacturing of soft gelatin or softgel capsule shells at a production scale was introduced by Robert Pauli Scherer in 1933 with the invention of a rotary die encapsulation machine. The rotary die process involves continuous formation of a heat seal between two ribbons of gelatin (also referred to as "gel mass" since it may contain plasticizers as listed below) simultaneous with dosing of the fill liquid into each capsule. Although manufacturing process speed and efficiency has improved with time, the basic manufacturing principle remains essentially unchanged. Before the encapsulation process takes place, two subprocesses are often carried out simultaneously, yielding the two components of a softgel capsule: (a) the gel mass which will provide the softgel capsule shell, and (b) the fill matrix for the softgel capsule contents. Softgel capsules have a continuous gelatin shell surrounding a liquid core, and are formed, filled, and sealed in one operation.

Softgel capsule walls are typically thicker than two-piece hard gelatin capsules, and their walls comprise plasticizers such as, for example, glycerol, sorbitol and/or propylene glycol to make the shell elastic. Processes for making softgel capsule shells are known, and softgel capsules are available commercially. See, e.g., Aulton, M., *Aulton's Pharmaceutics: The Design & Manufacture of Medicines,* 527-533 (Kevin M G Taylor, Ed., 3rd Ed., 2001). Softgel capsules have various advantages; they may show improved drug absorption, be easier to swallow, avoid dust handling issues, and have increased stability compared to other dosage forms. Softgel capsules may be filled with liquid fill such as but not limited to oils and/or lipid soluble active ingredients such as pharmaceuticals, veterinary products, foods and dietary supplements. Highly viscous products, pastes and solids such as powders may also be filled.

Typical materials for both hard capsules and softgels include gelatin (of various sources including bovine, porcine, poultry, and/or fish) or non-gelatin materials such as synthetic polymers and/or plant-derived hydrocolloids. Gelatin is favorably used as shell forming material, particularly of softgels, due to its unique physiochemical properties, namely its oxygen impermeability and the combination of film-forming capability and thermoreversible sol/gel formation, that favor its use for the industrial capsule production, especially the softgel production via the rotary die process.

Although both hard and soft capsules are capable of storing liquids therein, softgel capsules may be desirable in view of their capability of storing liquid fills without requiring additional sealing procedures, as well as in some instances provide stability advantages when utilizing certain fills in view of the higher plasticizer content. The plasticizer content in softgels may further bring resistance to brittleness and/or improved administration in applications such as vaginal or rectal administration.

It is often desirable to print capsules with indicia such to provide identification of the brand or type of product or production number and the like information thereon. This is typically done with a water-based ink.

Such common printing processes, however, do result in the production of a number of defect prints over a population of printed capsules, particularly when operating at high production speeds. This leads to a number of waste (or reject) product being generated. Particularly for softgels, where the printing is to be carried out post-filling. The rejected dosage forms can quickly result in costly scrap, particularly when the liquid fill comprises expensive pharmaceutically active substances.

A need therefore exists to provide a new printing process that limits such drawbacks, particularly in post-liquid-filling printing.

SUMMARY

A first aspect of the present disclosure relates a printing process for dosage forms selected from hard or soft capsules, said process comprising the steps of: (i) providing a plurality of said dosage forms, preferably filled with a liquid composition, in a reservoir; (ii) transferring a predetermined number of said dosage forms from said reservoir to a printing station; (iii) printing indicia over each of said dosage forms; (iv) transferring said printed dosage forms to an inspection station arranged to sense a predetermined characteristic of said indicia; (v) sorting said dosage forms based on the sensed predetermined characteristic of said indicia by separating dosage forms that meet said predetermined characteristics from dosage forms that do not meet said predetermined characteristics; wherein the dosage forms that do not meet said predetermined characteristics are collected and further processed through a regenerating unit arranged to remove said indicia from said dosage forms in a regeneration step, and further re-processed according to steps (i) to (v).

A further aspect of the present disclosure relates to the use of a process described herein to provide consistent quality of each printed liquid filled soft capsules without the need to scrap liquid filled soft capsules comprising a defective print.

BRIEF DESCRIPTION OF THE DRAWINGS

FIG. 1 is an illustration of a process flow chart according to an aspect of the disclosure.

DETAILED DESCRIPTION

By the term "a" and/or "an" when describing a particular element, it is intended "at least one" of that particular element.

By the term "medicament", it is intended a "drug" or the like comprising one or more compounds providing one or more curative benefits to a subject, the terms "medicament" and "drug" may be used interchangeably herein.

Various embodiments will now be described to provide an overall understanding of the principles of the structure, function, manufacture, uses and methods disclosed herein. One or more examples of these embodiments are illustrated in the accompanying figures. Those of ordinary skill in the art will immediately understand that features described or illustrated in connection with one example embodiment can be combined with the features of other example embodiments without generalization from the present disclosure.

The Process

The disclosure relates to a printing process for dosage forms selected from hard or soft capsules, said process comprising the steps of: (i) providing a plurality of said dosage forms in a reservoir; (ii) transferring a predetermined number of said dosage forms from said reservoir to a printing station; (iii) printing indicia over each of said dosage forms; (iv) transferring said printed dosage forms to an inspection station arranged to sense a predetermined characteristic of said indicia; (v) sorting said dosage forms based on the sensed predetermined characteristic of said indicia by separating dosage forms that meet said predetermined characteristics from dosage forms that do not meet said predetermined characteristics; wherein the dosage forms that do not meet said predetermined characteristics are collected and further processed through a regenerating unit arranged to remove said indicia from said dosage forms in a regeneration step, and further re-processed according to steps (i) to (v).

In an embodiment, the regeneration step is applied one or more times, preferably a single time after the rejection step.

In an embodiment, the capsules are filled with a liquid composition typically comprising a drug substance prior to the printing step.

In an embodiment, the printed indicia comprises a water based ink and preferably the printing station is an offset printing station.

In an embodiment, the regeneration step comprises contacting the dosage forms with a liquid composition comprising, preferably a mixture of, water, preferably purified (or demineralized) water, and an organic solvent. It has been found advantageous to provide such mixture of water and organic solvent for specific and effective removal of the oriented indicia.

In an embodiment, the organic solvent consists of one or more polar solvents, preferably selected from the group consisting of isopropanol, ethanol, dimethyl sulfoxide, ethyl acetate, acetone, and mixtures thereof, more preferably isopropanol.

Preferably, water is comprised at a level of from 2% to 10%, preferably from 3% to 8%, more preferably from 4% to 6%, by volume of the total volume of the liquid composition. Indeed, a small amount of water in the mixture has been found beneficial for effective removal of the ink of the print, however, if higher amounts of water are used, then disintegration or partial disintegration of the capsules may occur leading to undesirable leakage of the contents and/or hardness modification and/or stability of the capsule itself.

In an embodiment, the regenerating unit comprises a mixing device (also referred to herein as tumbling device) arranged to tumble said dosage forms within a rotating chamber, preferably wherein one or more woven or non-woven wipes are added to said mixing device, more preferably together with a plurality of dosage forms, prior to the step of removing the indicia from said dosage forms, said wipes typically being arranged to wipe and/or polish an external surface of said dosage forms during rotation of said rotating chamber. An advantage of this arrangement is further efficacy of the print removal from the capsules without damaging or piercing the capsules that would otherwise result in undesirable leakage of the contents.

In a preferred embodiment, the printed capsules are introduced into the mixing device, followed by an optional initial tumbling of from 4 to 10 minutes, preferably 5 to 8 minutes, more preferably about 6 minutes. A mixture of water and organic solvent, preferably isopropanol, as described herein is then typically added together or prior to adding the one or more wipes (woven or non-woven), after which a first tumbling step is applied to tumble the capsules, water/organic solvent mixture and the one or more wipes for a duration of from 4 to 10 minutes, preferably 5 to 8 minutes, more preferably about 6 minutes.

In an embodiment, after the first tumbling step, the solvent mixture is removed (typically by evaporation) in a first air exhaust cycle of from 2 to 5 minutes, preferably 2 to 3 minutes. In this step air, at room temperature, is injected into the tumbling device typically to accelerate the solvent removal. After the first air exhaust cycle the one or more wipes may be removed and an optional second air exhaust cycle of from 2 to 5 minutes, preferably 2 to 3 minutes is applied.

In an embodiment the printing process herein is a continuous process or batch process. Wherein by continuous process it is intended that the steps of the process occur in substantially immediate succession without storage and/or waiting times between steps.

In an embodiment, the transfer of dosage forms is carried out by a transfer belt comprising a plurality of cavities each arranged for retaining a dosage form therein. Typically the plurality of cavities extending both along the length of the transfer belt as well as the width of the transfer belt.

In an embodiment, the inspection system comprises one or more cameras and a processing means adapted to compare the images taken by said cameras with a predetermined image characteristic, and to provide a signal to a sorting device based on whether said predetermined image characteristic is met or not. Preferably, the sorting device is arranged to trigger a rejection or acceptance of at least one of the dosage forms based on the signal provided by the inspection system. Typically wherein the rejection or acceptance is carried out individually for each dosage form by actively and/or passively directing each one or more dosage forms into a reject bin or accept bin.

In an embodiment, a vacuum or compressed air is used to actively direct each one or more dosage forms into a reject bin or accept bin.

In an embodiment, gravitational force is used to passively direct each one or more dosage forms into a reject bin or accept bin.

In a preferred embodiment the process described herein is used for providing consistent quality of each printed liquid filled soft capsules without the need to scrap liquid filled soft capsules comprising a defective print.

Drug/Medicament

Drugs (i.e. medicaments) suitable for use in the dosage form articles described herein may take any form and be for any treatment of a human or animal subject. This includes not only pharmaceutical compounds but also dietary supplements such as vitamins, minerals and the like.

The drug may be in a state selected from solid or liquid, preferably liquid, at the filling temperature, generally room temperature and atmospheric pressure, and comprises one or more active compounds.

Suitable compounds (and generally encompassed by the term "medicament" as used herein) for delivery according to the disclosure include, but are not limited to, particulate, powder, waxy, liquid, and/or pellet forms of the following:

a) pharmaceuticals (also called pharmaceutical actives) such as betamethasone, thioctic acid, sotalol, salbutamol, norfenefrine, silymahn, dihydroergotamine, buflomedil, etofibrate, indomethacin, oxazepam, acetyldigitoxins, piroxicam, halopehdol, isosorbide mononitrate, amithptyline, diclofenac, nifedipine, verapamil, pyritinol, nitrendipine, doxy-cycline, bromhexine, methylprednisolone, clonidine, fenofibrate, allopurinol, pirenzepine, levothyroxine, tamoxifen, metildigoxin, o-(B-hydroxyethyl)-rutoside, propicillin, aciclovir-mononitrate, paracetamolol, naftidrofuryl, pentoxifylline, propafenone, acebutolol, 1-thyroxin, tramadol, bromocriptine, loperamide, ketofinen, fenoterol, ca-dobesilate, propranolol, minocycline, nicergoline, ambroxol, metoprolol, B-sitosterin, enalaprilhydro-genmaleate, bezafibrate, isosorbide dinitrate, gallopamil, xantinolnicotinate, digitoxin, flunitrazepam, bencyclane, depanthenol, pindolol, lorazepam, diltiazem, piracetam, phenoxymethylpenicillin, furosemide, bromazepam, flunarizine, erythromycin, metoclo-pramide, acemetacin, ranitidine, biperiden, metamizol, doxepin, dipotassiumchloraze-pat, tetrazepam, estramustinephosphate, terbutaline, captopril, maprotiline, prazosin, atenolol, glibenclamid, cefaclor, etilefrin, cimetidine, theophylline, hydromorphone, ibu-profen, primidone, clobazam, oxaceprol, medroxyprogesterone, flecainide, Mg-pyhdoxal-5-phosphateglutaminate, hymechromone, etofyllineclofibrate, vincamine, cin-narizine, diazepam, ketoprofen, flupentixol, molsidomine, glibornuhde, dimethindene, melperone, soquinolol, dihydrocodeine, clomethiazole, clemastine, glisoxepid, kallidino-genase, oxyfedhne, baclofen, carboxymethylcystsin, thioredoxin, betahistine, 1-tryptophan, myrtol, bromelain, prenylamine, salazosulfapyridine, astemizole, sulpiride, benzerazid, dibenzepin, acetylsalicylic acid, miconazole, nystatin, ketoconazole, sodium picosulfate, colestyramate, gemfibrozil, rifampin, fluocortolone, mexiletine, amoxicillin, terfenadine, mucopolysaccharidpolysulfuric acid, triazolam, mianserin, tiaprofensaure, ameziniummethylsulfate, mefloquine, probucol, quinidine, carbamazepine, Mg-1-aspartate, penbutolol, piretanide, amitriptyline, caproteron, sodium valproinate, mebeverine, bisacodyl, 5-amino-salicyclic acid, dihydralazine, magaldrate, phenprocou-mon, amantadine, naproxen, carteolol, famotidine, methyldopa, auranofine, estriol, nadolol, levomepromazine, doxorubicin, medofenoxat, azathioprine, flutamide, norfloxacin, fendiline, prajmaliumbitartrate, aescin acromycin, anipamil, benzocaine, [beta]-carotene, cloramphenicol, chlorodiazepoxid, chlormadinoneacetate, chlorothiazide, cin-narizine, clonazepam, codeine, dexamethasone, dicumarol, digoxin, drotaverine, grami-cidine, griseofulvin, hexobarbital hydrochlorothiazide, hydrocortisone, hydroflumethiazide, ketoprofen, lonetil, medazepam, mefruside, methandrostenolone, sulfaperine, nalidixic acid, nitrazepam, nitrofurantoin, estradiol, papaverine, phenacetin, phenobarbi-tal, phenylbutazone, phenytoin, prednisone, reserpine, spironolactine, streptomycin, sul-famethizole, sulfamethazine, sulfamethoxoazole, sulfamethoxydiazinon, sulfathiazole, sulfisoxazole, testosterone, tolazamide, tolbutamide, trimethoprim, tyrothricin, antacids, reflux suppressants, antiflatulents, antidopaminergics, proton pump inhibitors, H2-receptor antagonists, cytoprotectants, prostaglandin analogues, laxatives, antispasmodics, antidiarrhoeals, bile acid sequestrants, opioids, beta-receptor blockers, calcium channel blockers, diuretics, cardiac glycosides, antiarrhythmics, nitrates, antianginals, vasoconstrictors, vasodilators, ACE inhibitors, angiotensin receptor blockers, alpha blockers, anticoagulants, heparin, antiplatelet drugs, fibrinolytic, anti-hemophilic factor, haemostatic drugs, hypolipidaemic agents, statins, hypnotics, anaesthetics, antipsychotics, antidepressants (including tricyclic antidepressants, monoamine oxidase inhibitors, lithium salts, selective serotonin reuptake inhibitors), anti-emetics, anticonvulsants, an-tiepileptics, anxiolytics, barbiturates, movement disorder drugs, stimulants (including amphetamines), benzodiazepine, cyclopyrrolone, dopamine antagonists, antihistamines, cholinergics, anticholinergics, emetics, cannabinoids, 5-HT antagonists, analgesics, muscle relaxants, antibiotics, sulfa drugs, aminoglycosides, fluoroquinolones, bronchodilators, NSAIDs, anti-allergy drugs, antitussives, mucolytics, decongestants, corticosteroids, beta-receptor antagonists, anticholinergics, steroids, androgens, antian-drogens, gonadotropin, corticosteroids, growth hormones, insulin, antidiabetic drugs (including sulfonylurea, biguanide/metformin, and thiazolidinedione), thyroid hormones, antithyroid drugs, calcitonin, diphosponate, vasopressin analogs, contraceptives, follicle stimulating hormone, luteinising hormone, gonadotropin release inhibitor, progestogen, dopamine agonists, oestrogen, prostaglandin, gonadorelin, clomiphene, tamoxifen, di-ethylstilbestrol, antimalarials, anthelmintics, amoebicides, antivirals, antiprotozoals, vaccines, immunoglobulin, immunosuppressants, interferon, monoclonal antibodies, and mixtures thereof;

b) vitamins, e.g., fat-soluble vitamins such as vitamins A, D, E, and K, and water soluble vitamins such as vitamin C, biotin, folate, niacin, pantothenic acid, riboflavin, thiamin, vitamin B6, vitamin B12, and mixtures thereof;

c) minerals, such as calcium, chromium, copper, fluoride, iodine, iron, magnesium, manganese, molybdenum, phosphorus, potassium, selenium, sodium (including sodium chloride), zinc, and mixtures thereof;

d) dietary supplements such as herbs or other botanicals, amino acids, and substances such as enzymes, organ tissues, glandulars, and metabolites, as well as concentrates, metabolites, constituents, extracts of dietary ingredients, oils such as krill oil and mixtures thereof;

e) homoeopathic ingredients such as those listed in the Homeopathic Pharmacopoeia of the United States Revision Service (HPRS), and mixtures thereof. It must be recognized, of course, that the HPRS is periodically updated and that the present invention includes homeopathic ingredients that may be added to the HPRS;

f) probiotics and yeast, such as bacteria selected from the group consisting of *Lactobacillus* (Döderlein's *bacilli*) such as *Lactobacillus crispatus, Lactobacillus jensinii, Lactobacillus johnsonii, Lactobacillus gasseri, Enterococcus*

*faecium*, or fungi selected from the group of Saccharomycetales such as *Saccharomyces boulardii*.

g) hormones, such as estrogen (i.e. a natural estrogen or a synthetic compound that mimics the physiological effect of natural estrogens) including, without limitation, estradiol (17-estradiol), estridiol acetate, estradiol benzoate, estridiol cypionate, estridiol decanoate, estradiol diacetate, estradiol heptanoate, estradiol valerate, 17a-estradiol, estriol, estriol succinate, estrone, estrone acetate, estrone sulfate, estropipate (piperazine estrone sulfate), ethynylestradiol (17a-ethynylestradiol, ethinylestradiol, ethinyl estradiol, ethynyl estradiol), ethynylestradiol 3-acetate, ethynylestradiol 3-benzoate, mestranol, quinestrol, nitrated estrogen derivatives or combinations thereof; or progestin (i.e. natural or synthetic compounds that possesses progestational activity including, without limitation, nortestosterone, ethynyltestosterone, deacetylnorgestimate, hydroxyprogesterone, 19-norprogesterone, 3P-hydroxydesogestrel, 3-ketodesogestrel (etonogestrel), acetoxypregnenolone, algestone acetophenide, allylestrenol, amgestone, anagestone acetate, chlormadinone, chlormadinone acetate, cyproterone, cyproterone acetate, demegestone, desogestrel, dienogest, dihydrogesterone, dimethisterone, drospirenone, dydrogesterone, ethisterone (pregneninolone, 17a-ethynyltestosterone), ethynodiol diacetate, fluorogestone acetate, gastrinone, gestadene, gestodene, gestonorone, gestrinone, hydroxymethylprogesterone, hydroxymethylprogesterone acetate, hydroxyprogesterone, hydroxyprogesterone acetate, hydroxyprogesterone caproate, levonorgestrel (1-norgestrol), lynestrenol (lynoestrenol), mecirogestone, medrogestone, medroxyprogesterone, medroxyprogesterone acetate, megestrol, megestrol acetate, melengestrol, melengestrol acetate, nestorone, nomegestrol, norelgestromin, norethindrone (norethisterone) (19-nor-17a-ethynyltestosterone), norethindrone acetate (norethisterone acetate), norethynodrel, norgestimate, norgestrel (d-norgestrel and dl-norgestrel), norgestrienone, normethisterone, progesterone, promegestone, quingestanol, tanaproget, tibolone, trimegestone, or combinations thereof.

and mixtures in any combination of the foregoing.

In an embodiment, the medicament is acid instable. The term "acid instable" as used herein typically means substances that tend to react and/or decompose at low pH, typically pH less than 6, including substances associated with gastric side effects in humans and/or animals. Non-limiting examples of such substances include enzymes, bacteria such as bifidobacteria, certain dietary supplements such as valerian root, garlic, and the like.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm" (i.e. every value in a practical range close to 40 mm).

The invention claimed is:

1. A printing process for dosage forms selected from hard or soft capsules, said process comprising the steps of:

(i) providing a plurality of said dosage forms in a reservoir;

(ii) transferring a predetermined number of said dosage forms from said reservoir to a printing station;

(iii) printing indicia over each of said dosage forms;

(iv) transferring said printed dosage forms to an inspection station arranged to sense a predetermined characteristic of said indicia;

(v) sorting said dosage forms based on the sensed predetermined characteristic of said indicia by separating dosage forms that meet said predetermined characteristics from dosage forms that do not meet said predetermined characteristics;

wherein the dosage forms that do not meet said predetermined characteristics are collected and further processed through a regeneration unit arranged to remove said indicia from said dosage forms in a regeneration step, and further re-processed according to steps (i) to (v).

2. A printing process according to claim 1 wherein the printed indicia comprises a water based ink.

3. A printing process according to claim 1 wherein the regeneration step comprises contacting the dosage forms with a liquid composition comprising water and an organic solvent.

4. A printing process according to claim 3 wherein the organic solvent consists of one or more polar solvents selected from the group consisting of isopropanol, ethanol, dimethyl sulfoxide, ethyl acetate, acetone, and mixtures thereof.

5. A printing process according to claim 3 wherein water is comprised at a level of from 2% to 10% by volume of the total volume of the liquid composition.

6. A printing process according to claim 1 wherein the regeneration unit comprises a mixing device arranged to tumble said dosage forms within a rotating chamber, prior to the step of removing the indicia from said dosage forms.

7. A printing process according to claim 6 wherein one or more wipes are added to the mixing device, prior to the step of removing the indicia from the dosage forms, wherein the wipes are arranged to wipe an external surface of the dosage forms during rotation of the rotating chamber.

8. A printing process according to claim 1 wherein said process is a continuous process.

9. A printing process according to claim 1 wherein the transfer of dosage forms is carried out by a transfer belt comprising a plurality of cavities each arranged for retaining a dosage form therein.

10. A printing process according to claim 1 wherein the inspection system comprises one or more cameras and a processing means adapted to compare the images taken by said cameras with a predetermined image characteristic, and to provide a signal to a sorting device based on whether said predetermined image characteristic is met or not.

11. A printing process according to claim 10 wherein the sorting device is arranged to trigger a rejection or acceptance of at least one of the dosage forms based on the signal provided by the inspection system.

12. A printing process according to claim 11 wherein the rejection or acceptance is carried out individually for each dosage form by actively and/or passively directing each one or more dosage forms into a reject bin or accept bin.

13. A printing process according to claim 12 wherein a vacuum or compressed air is used to actively direct each one or more dosage forms into a reject bin or accept bin.

14. A printing process according to claim 12 wherein gravitational force is used to passively direct one or more dosage forms into a reject bin or accept bin.

15. A printing process according to claim 1 wherein the steps are carried out in sequence.

16. A printing process according to claim 1 wherein the printing station is an offset printing station.

* * * * *